US008091149B2

(12) United States Patent
Choi

(10) Patent No.: US 8,091,149 B2
(45) Date of Patent: Jan. 10, 2012

(54) HELMET

(75) Inventor: Kwangmoon Choi, Gyeonggi-do (KR)

(73) Assignee: HJC Co., Ltd. (KR)

( * ) Notice: Subject to any disclaimer, the term of this patent is extended or adjusted under 35 U.S.C. 154(b) by 407 days.

(21) Appl. No.: 12/319,926

(22) Filed: Jan. 14, 2009

(65) Prior Publication Data

US 2009/0183302 A1 Jul. 23, 2009

(30) Foreign Application Priority Data

Jan. 21, 2008 (KR) ..... 10-2008-0006290

(51) Int. Cl.
*A42B 1/08* (2006.01)

(52) U.S. Cl. ..... 2/424

(58) Field of Classification Search ..... 2/422, 424, 2/15, 6.2, 6.3, 6.4, 6.5, 6.7, 6.8, 9
See application file for complete search history.

(56) References Cited

U.S. PATENT DOCUMENTS

| | | | | |
|---|---|---|---|---|
| 4,766,609 | A * | 8/1988 | Lane | 2/5 |
| 5,461,731 | A * | 10/1995 | Shida | 2/424 |
| 6,622,314 | B1 * | 9/2003 | Kim et al. | 2/424 |
| 6,654,969 | B2 * | 12/2003 | Taniuchi | 2/424 |
| 7,065,798 | B2 * | 6/2006 | Kuo | 2/424 |
| 7,814,579 | B2 * | 10/2010 | Dion | 2/425 |
| 2003/0088907 | A1 * | 5/2003 | Gafforio et al. | 2/424 |
| 2006/0117467 | A1 * | 6/2006 | Choi et al. | 2/424 |
| 2006/0230507 | A1 * | 10/2006 | Yeh | 2/410 |

* cited by examiner

*Primary Examiner* — Gary L Welch
*Assistant Examiner* — Anna Kinsaul
(74) *Attorney, Agent, or Firm* — Lerner, David, Littenberg, Krumholz & Mentlik, LLP

(57) ABSTRACT

A helmet is provided including an attachable and detachable shield plate by a simple structure. The helmet includes a helmet main body; a first plate positioned onto an outer surface of the helmet main body; a second plate structurally combined with the first plate and capable of sliding between a locking position and an unlocking position with respect to the first plate; a spring for pressurizing the second plate toward the locking position; and a shield plate capable of rotating with respect to the helmet main body and attachably and detachably installed on the first plate by the slide movement.

6 Claims, 7 Drawing Sheets

HELMET

CROSS-REFERENCE TO RELATED APPLICATION

This application claims the benefit of Korean Patent Application 10-2008-0006290, filed on Jan. 21, 2008, which is hereby incorporated by reference in its entirety.

FIELD OF THE INVENTION

The present disclosure relates to a helmet and in particular to a helmet including an attachable and detachable shield plate.

BACKGROUND OF THE INVENTION

When a user rides a mobile vehicle such as a motorcycle on which the user is exposed to the outside, wearing a helmet becomes more important for the user's safety.

A helmet generally includes a helmet main body and a shield plate capable of opening and closing with respect to the helmet main body. The shield plate is coupled with the helmet main body by means of a coupling member such as a screw or the like.

However, when the shield plate is replaced according to the user's demands or the status of consumption thereof, it has been inconvenient to separate the coupling member from the helmet and connect the coupling member with the helmet again after replacing the shield plate with a new one and.

In order to solve this conventional inconvenience as mentioned above, there has been developed a helmet which includes a coupling member between the helmet main body and the shield plate so as to make it possible to easily attach and detach the shield plate to and from the helmet main body. However, there still exists a problem in that the coupling member for combining the shield plate with the helmet main body in the above-stated helmet is rather complicatedly constructed so that cost for manufacturing the helmet is increased.

As one of the conventional technologies in this regard, an invention entitled "Structure for installing shielding plate in helmet" is disclosed in Korean Patent Application No. 10-1994-0009409.

This conventional technology discloses a structure capable of reinforcing a binding strength of a shielding plate by engaging at least two places of the shielding plate with one locking member.

However, in this conventional technology, a locking lever constituting a coupling member is coupled with an installing plate by means of a guide hook so that the locking lever can be separated from the installing plate.

Further, the coupling member of this conventional technology is complicatedly configured in that a supporting shaft of the locking lever is rotatably inserted and engaged into a shaft hole formed on the installing plate.

BRIEF SUMMARY OF THE INVENTION

The object of an embodiment of the present invention is to solve the above-stated problems by providing a helmet having a simply configured coupling member.

In order to solve the above-stated technical problems, there is provided a helmet including: a helmet main body; a first plate fixed onto an outer surface of the helmet main body; a shield plate attachably and detachably installed on the first plate; a second plate combined with the first plate and moving to a locking position or an unlocking position with respect to the first plate; and a spring for pressurizing the second plate toward the locking position, wherein the first plate includes: a supporting sphere formed in a circular shape; a first sliding unit formed after a part of a circumferential wall of the supporting sphere is removed; a protruding partition wall extending from an outside of the supporting sphere and formed into a circular arc shape concentric with a circumferential wall of the supporting sphere; and a second sliding unit formed in one end portion of the protruding partition wall, the shield plate includes: a rotation shaft rotatably combined with the supporting sphere; a first rotating hook formed in the rotation shaft; a click protruding unit engaged with a shield rotating guide groove formed along an outer periphery of the protruding partition wall; and a second rotating hook formed in the click protruding unit, the second plate includes: a first locking unit engaged with the first sliding unit and a second locking unit engaged with the second sliding unit, and spaces where the first and second sliding units are formed extend toward the outside of the circumferential wall of the supporting sphere and form a slide guide groove, the second plate slides along the slide guide groove, and the first and second rotating hooks are engaged with or disengaged from the first locking unit and the second locking unit respectively in the first and the second sliding units, thereby moving between the locking position and the unlocking position.

The first plate includes: a first structural coupling groove formed on an upper rear surface of the first sliding unit; a second structural coupling groove formed on an upper rear surface of the second sliding unit; and a third structural coupling groove formed on an inner peripheral rear surface of the protruding partition wall, the second plate includes: a first structural coupling hook, a second structural coupling hook and a third structural coupling hook formed on places each corresponding to the first, second and third structural coupling grooves, and the first to third structural coupling hooks can be inserted into a rear surface of the first plate from a top surface thereof so as to be slid into the first to third structural coupling grooves respectively.

The first plate includes: a first guide groove formed on an inner peripheral rear surface of the supporting sphere; and a second guide groove formed on an outer peripheral rear surface of the protruding partition wall, a second plate includes: a first locking groove extended from the first guide groove and formed on a rear surface of an end portion of the first locking unit; and a second locking groove extended from the second guide groove and formed on a rear surface of an end portion of the second locking unit, and when the shield plate rotates, the first rotating hook of the shield plate can rotate along the first locking groove and the first guide groove and the second rotating hook of the shield plate can rotate along the second locking groove and the second guide groove.

A top surface of the end portion of the first locking unit and a top surface of the end portion of the second locking unit of the second plate can be slantly formed.

An inner wall of the outside of the shield rotating guide groove and an outer surface of the click protruding portion 540 inserted and guided into the shield rotating guide groove are formed in a continuous wave shape and engaged with each other so that the shield plate can be fixed step by step when the shield plate main body rotates.

The first plate further may include a first spring supporting unit for supporting one end portion of the spring, and the second plate further may include a second spring supporting unit for supporting the other end portion of the spring while facing the first spring supporting unit.

The second plate further may include a lever with which a slide movement of the second plate can be manipulated.

In accordance with one of the above-stated solutions of the present invention, the helmet includes the second plate coupled with the first plate by means of a plurality of coupling hooks and capable of sliding between the locking position and the unlocking position with respect to the first plate so that it is effective to simplify the structure thereof.

BRIEF DESCRIPTION OF THE DRAWINGS

The disclosure may best be understood by reference to the following description taken in conjunction with the following figures.

DETAILED DESCRIPTION OF THE INVENTION

Figure 1:
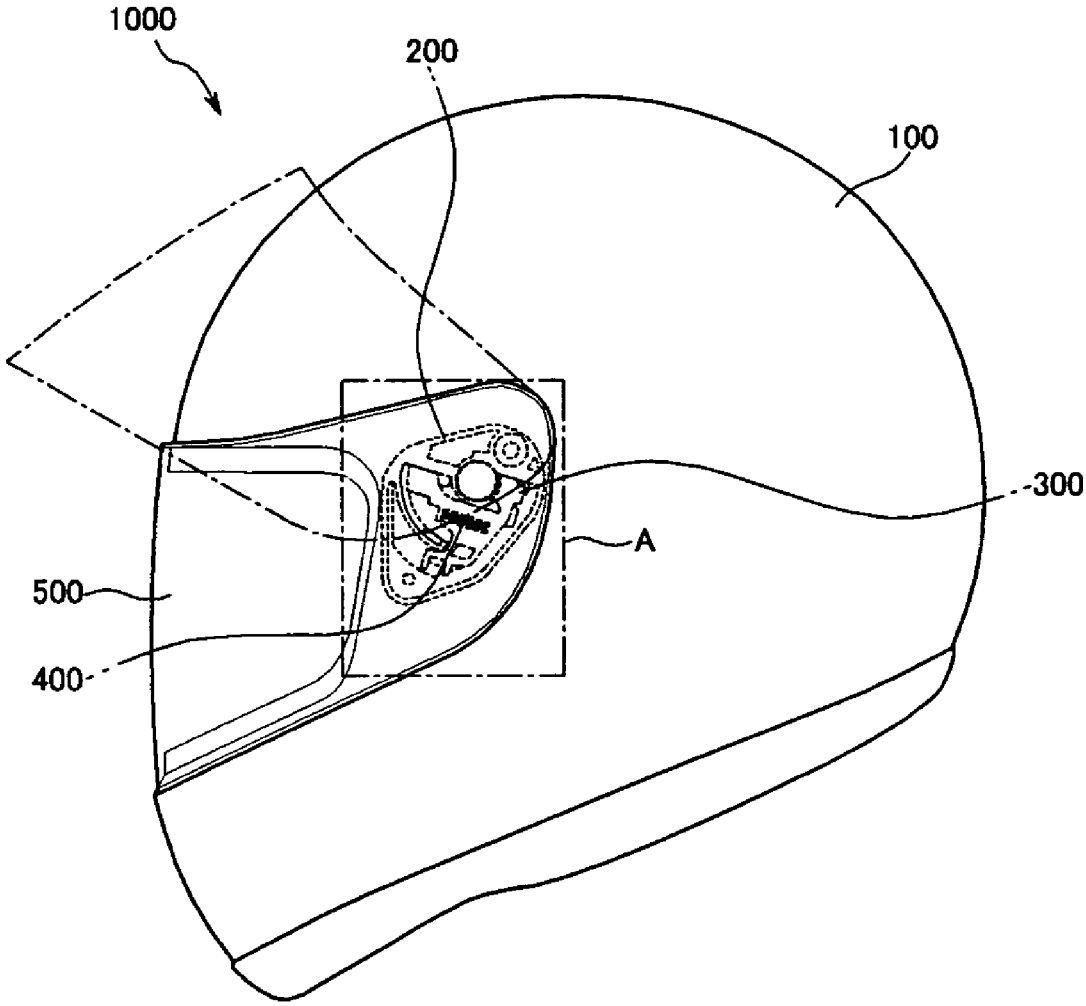
FIG. 1 is a perspective view of a helmet in accordance with an embodiment of the present invention.

Hereinafter, embodiments of the present invention will be described in detail with reference to the accompanying drawings so that the present invention may be readily implemented by those skilled in the art. However, it is to be noted that the present invention is not limited to the embodiments but can be realized in various other ways. In the drawings, parts irrelevant to the description are omitted for the simplicity of explanation, and like reference numerals denote like parts through the whole document.

Through the whole document, the term "comprises or includes" and/or "comprising or including" means that one or more other components and/or existence or addition of elements are not excluded in addition to the described components and/or elements.

Hereinafter, a helmet in accordance with an embodiment of the present invention will be explained with reference to the accompanying drawings.

Figure 2:
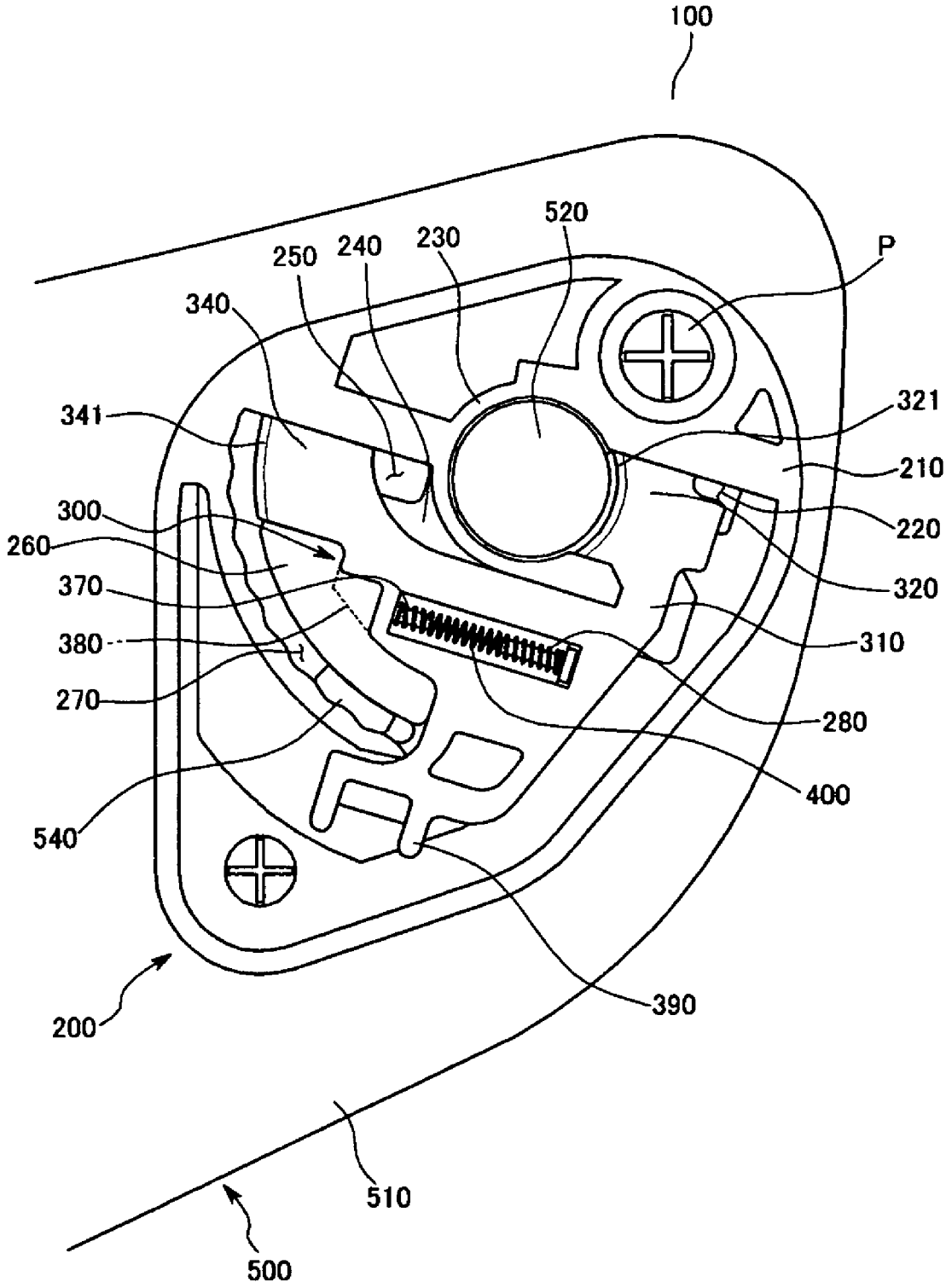
FIG. 2 is an enlarged view of a part A of FIG. 1.
Figure 3:
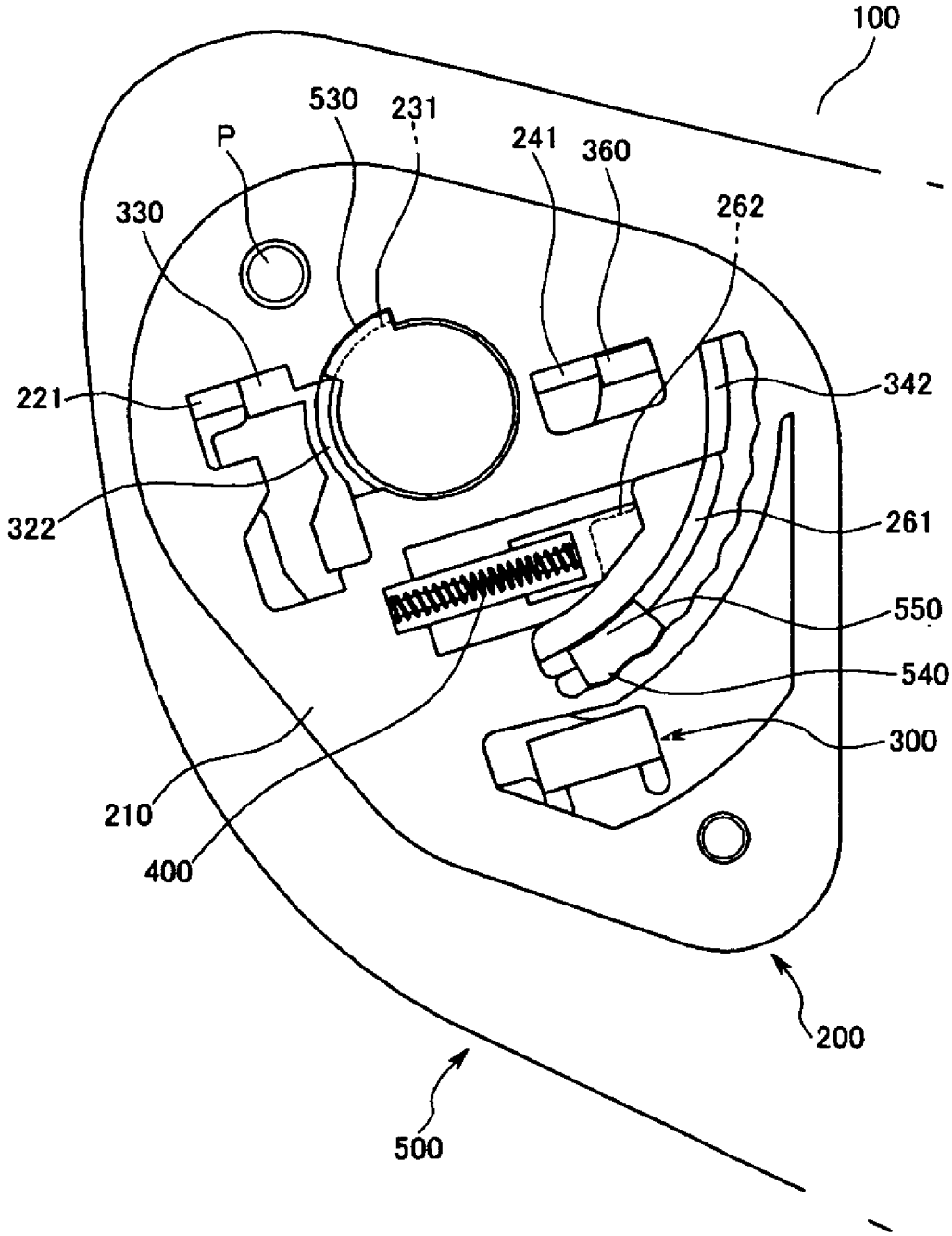
FIG. 3 is a rear view of FIG. 2.

FIG. 1 is a perspective view of a helmet in accordance with an embodiment of the present invention; FIG. 2 is an enlarged view of a part A of FIG. 1; FIG. 3 is a rear view of FIG. 2; and FIG. 4 is an exploded perspective view of a principal part of the helmet in accordance with the embodiment of the present invention.

As illustrated in FIG. 1, a helmet 1000 in accordance with an embodiment of the present invention includes a helmet main body 100, a first plate 200, a second plate 300, a spring 400 and a shield plate 500.

The helmet main body 100 is worn to protect a user from a variety of head injuries when the user rides a mobile vehicle. A position facing the user's eyes is exposed to the outside so as to allow the user to see a front view. The first plate 200 is fixed on an outer surface of the helmet main body 100 and the shield plate 500 is rotatably installed on an outer surface of the first plate 200.

Figure 4:
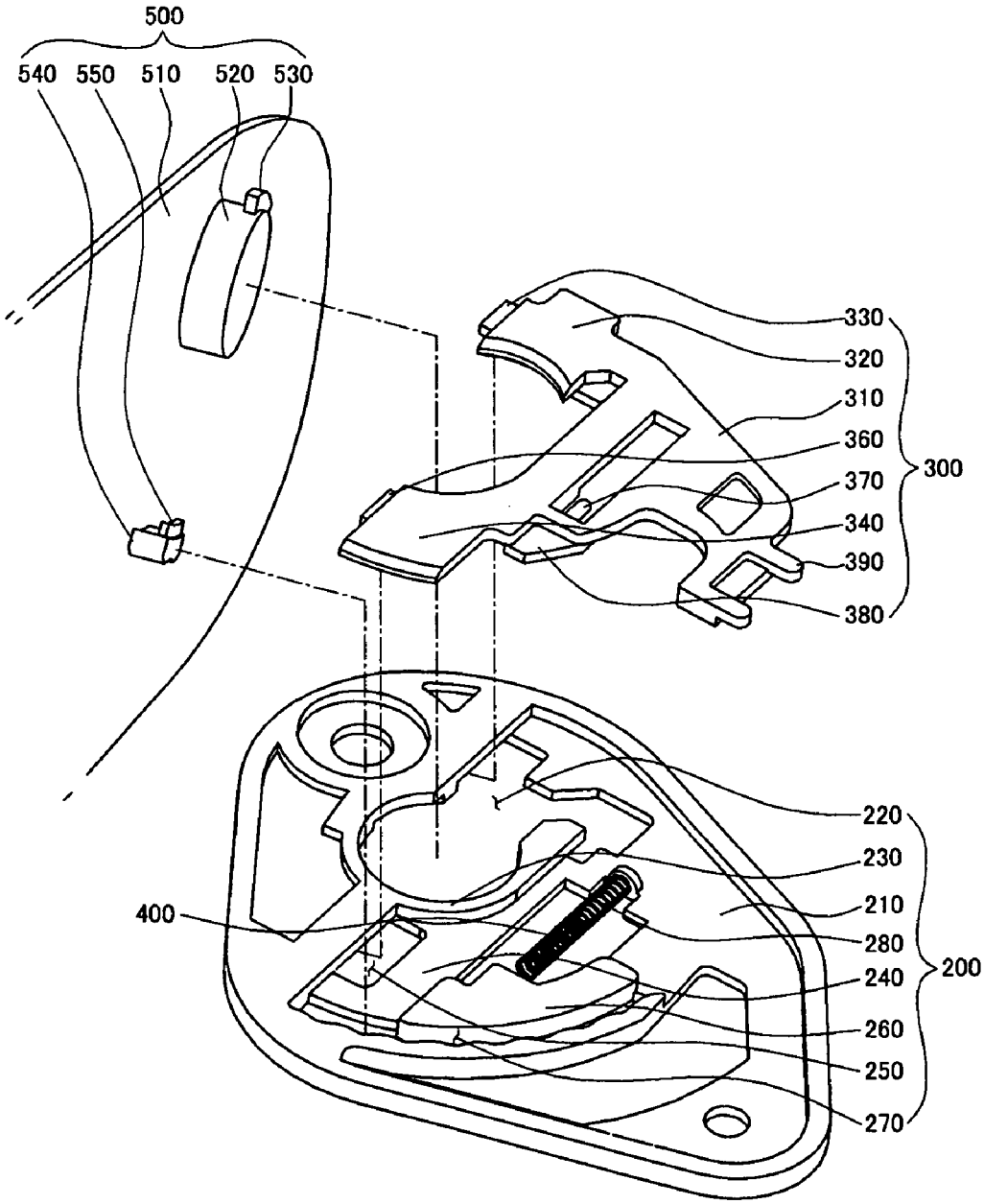
FIG. 4 is an exploded perspective view of a principal part of a helmet in accordance with an embodiment of the present invention.

As illustrated in FIGS. 2 to 4, the first plate 200 includes a first plate main body 210, a first sliding unit 220, a supporting sphere 230, a second sliding unit 240, a slide guide groove 250, a protruding partition wall 260, a shield rotating guide groove 270 and a first spring supporting unit 280.

The first plate main body 210 is positioned on an outer surface of the helmet main body 100 and fixed to the helmet main body 100 by means of a coupling screw P.

As illustrated in FIG. 2, the first sliding unit 220 is formed as an open space where a part of the circumferential wall of the supporting sphere 230 is removed, and as illustrated in FIG. 3, a first structural coupling groove 221 is formed on an upper rear surface of the first sliding unit 220.

The supporting sphere 230 is extended from the first sliding unit 220 and formed into a circular shape. A first guide groove 231 is formed on an inner peripheral rear surface of the supporting sphere 230.

As illustrated in FIG. 2, the second sliding unit 240 is formed on an outside space of the supporting sphere 230, and as illustrated in FIG. 3, a second structural coupling groove 241 is formed on an upper rear surface of the second sliding unit 240.

The spaces on which the first sliding unit 220 and the second sliding unit 240 are formed are continuously extended toward the outside of the circumferential wall of the supporting sphere 230 and form the slide guide groove 250 where it is possible for the following second plate 300 to make a slide movement.

The protruding partition wall 260 protrudes and extends from the second sliding unit 240 and is formed into a circular arc shape approximately concentric with the circumferential wall of the supporting sphere 230. As illustrated in FIG. 3, a second guide groove 261 is formed on an outer peripheral rear surface of the protruding partition wall 260, and a third structural coupling groove 262 is formed on an inner peripheral rear surface of the protruding partition wall 260.

The shield rotating guide groove 270 is formed along the outer periphery of the protruding partition wall 260. The first plate main body 210 facing the outer periphery of the protruding partition wall 260 is formed into a continuous wave shape.

The first spring supporting unit 280 is disposed between the first sliding unit 220 and the protruding partition wall 260 and protrudes from the first plate main body 210 in a direction parallel to an extending direction of the slide guide groove 250.

The second plate 300 is slidably installed on the first plate 200 along the slide guide groove 250. Hereinafter, the second plate 300 will be explained in detail.

The second plate 300 includes a second plate main body 310, a first locking unit 320, a first structural coupling hook 330, a second locking unit 340, a second structural coupling hook 360, a second spring supporting unit 370, a third structural coupling hook 380 and a lever 390.

The second plate main body 310 is positioned on an outer wall of the first plate main body 210 and faced with the first plate main body 210. The second plate main body 310 slides between a locking position and an unlocking position along the slide guide groove 250 of the first plate main body 210.

The first locking unit 320 is positioned on one side of the second plate main body 310 and its one end portion is formed into a circular arc shape extended from the circumferential wall of the supporting sphere 230. A top surface 321 of the end portion of the first locking unit 320 extended from the circumferential wall of the supporting sphere 230 is slantly formed. A first locking groove 322 extended from the first guide groove 231 is formed on the rear surface of the end portion of the first locking unit 320. The first locking unit 320 slides between the locking position and the unlocking position through the first sliding unit 220.

The second locking unit 340 is positioned on the other side of the second plate main body 310 and its one end portion is formed into a protruding circular arc shape extended from the circular arc shape of the protruding partition wall 260. A top surface 341 of the end portion of the second locking unit 340 extended from the protruding partition wall 260 is slantly formed. A second locking groove 342 extended from the second guide groove 261 is formed on the rear surface of the end portion of the second locking unit 340. The second locking unit 340 slides between the locking position and the unlocking position through the second sliding unit 240.

The first locking unit 320 and the second locking unit 340 are formed as one body. Accordingly, if the second plate 300 slides along the slide guide groove 250, the first locking unit 320 slides together with the second locking unit 340 between the locking position and the unlocking position.

The first to third structural coupling hooks 330, 360 and 380 are structurally combined with the first to third structural coupling grooves 221, 241 and 262 respectively so as to prevent the second plate 300 from being detached from the first plate 200.

In particular, the first structural coupling hook 330 of the second plate 300 is inserted into the rear surface of the first plate 200 from the top surface thereof and structurally combined with the first structural coupling groove 221. When the second plate 300 slides, the first structural coupling hook 330 slides along the first structural coupling groove 221.

The second structural coupling hook 360 of the second plate 300 is inserted into the rear surface of the first plate 200 from the top surface thereof and structurally combined with the second structural coupling groove 241. When the second plate 300 slides, the second structural coupling hook 360 slides along the second structural coupling groove 241.

The third structural coupling hook 380 of the second plate 300 is inserted into the rear surface of the first plate 200 from the top surface thereof and structurally combined with the third structural coupling groove 262. When the second plate 300 slides, the third structural coupling hook 380 slides along the third structural coupling groove 262.

As stated above, at three places, the first to third structural coupling hooks 330, 360 and 380 are coupled with the first to third structural coupling grooves 221, 241 and 262 respectively so that the second plate 300 can be installed on the first plate 200 with more stability.

The lever 390 is positioned at a lower portion of the second plate main body 310. By pressurizing the lever 390 with the user's finger or the like, it is possible to induce a slide movement of the second plate main body 310. If one end portion of the lever 390 touches one side of the first plate main body 210, it is possible to stop the slide movement of the second plate main body 310.

The second spring supporting unit 370 protrudes from the second plate main body 310 in a direction substantially parallel to an extending direction of the slide guide groove 250. The second spring supporting unit 370 faces the first spring supporting unit 280 spaced apart therefrom by a predetermined distance.

The second spring supporting unit 370 together with the first spring supporting unit 280 supports the spring 400.

The first spring supporting unit 280 and the second spring supporting unit 370 are inserted into each of the end portions of the spring 400 so that the spring 400 pressurizes the second plate 300 toward the locking position.

The shield plate 500 includes a shield plate main body 510, a rotation shaft 520, a first rotating hook 530, a click protruding portion 540 and a second rotating hook 550. The shield plate 500 can be closed and opened with respect to an exposed portion of the helmet main body 100 facing the user's eyes. The shield plate main body 510 is made of a transparent resin and its both sides are positioned on the outer surface of the helmet main body 100.

The rotation shaft 520 protrudes from a side portion of the shield plate main body 510 and is loosely inserted into the supporting sphere 230. When the shield plate main body 510 is closed and opened with respect to the exposed portion of the helmet main body 100, the shield plate main body 510 rotates centering on the rotation shaft 520.

The first rotating hook 530 protrudes by bending and extending from one end portion of the rotation shaft 520. The first rotating hook 530 can move between the first guide groove 231 and the first locking groove 322 when the shield plate main body 510 rotates.

The click protruding portion 540 protrudes form the shield plate main body 510 spaced apart from the rotation shaft 520 by a predetermined distance. The click protruding portion 540 is inserted into the shield rotating guide groove 270, and the click protruding portion 540 rotates along the shield rotating guide groove 270 and guides a rotation of the shield plate main body 510 when the shield plate main body 510 rotates centering on the rotation shaft 520.

The outer surface of the click protruding portion 540 rotating along the shield rotating guide groove 270 is formed in the same as the continuous wave shape of the first plate main body 210 constituting the shield rotating guide groove 270 and engaged with the first plate main body 210. Since the wave shape of the shield rotating guide groove 270 and the protruding wave shape of the click protruding portion 540 are engaged with each other, the shield plate 500 can be fixed step by step when the shield plate main body 510 rotates.

The second rotating hook 550 protrudes by bending and extending from one end portion of the click protruding portion 540. The second rotating hook 550 can move between the second guide groove 261 and the second locking groove 342 when the shield plate main body 510 rotates.

Hereinafter, a procedure of separating the shield plate 500 from the helmet main body 100 will be explained with reference to FIGS. 5 and 6.

Figure 5:
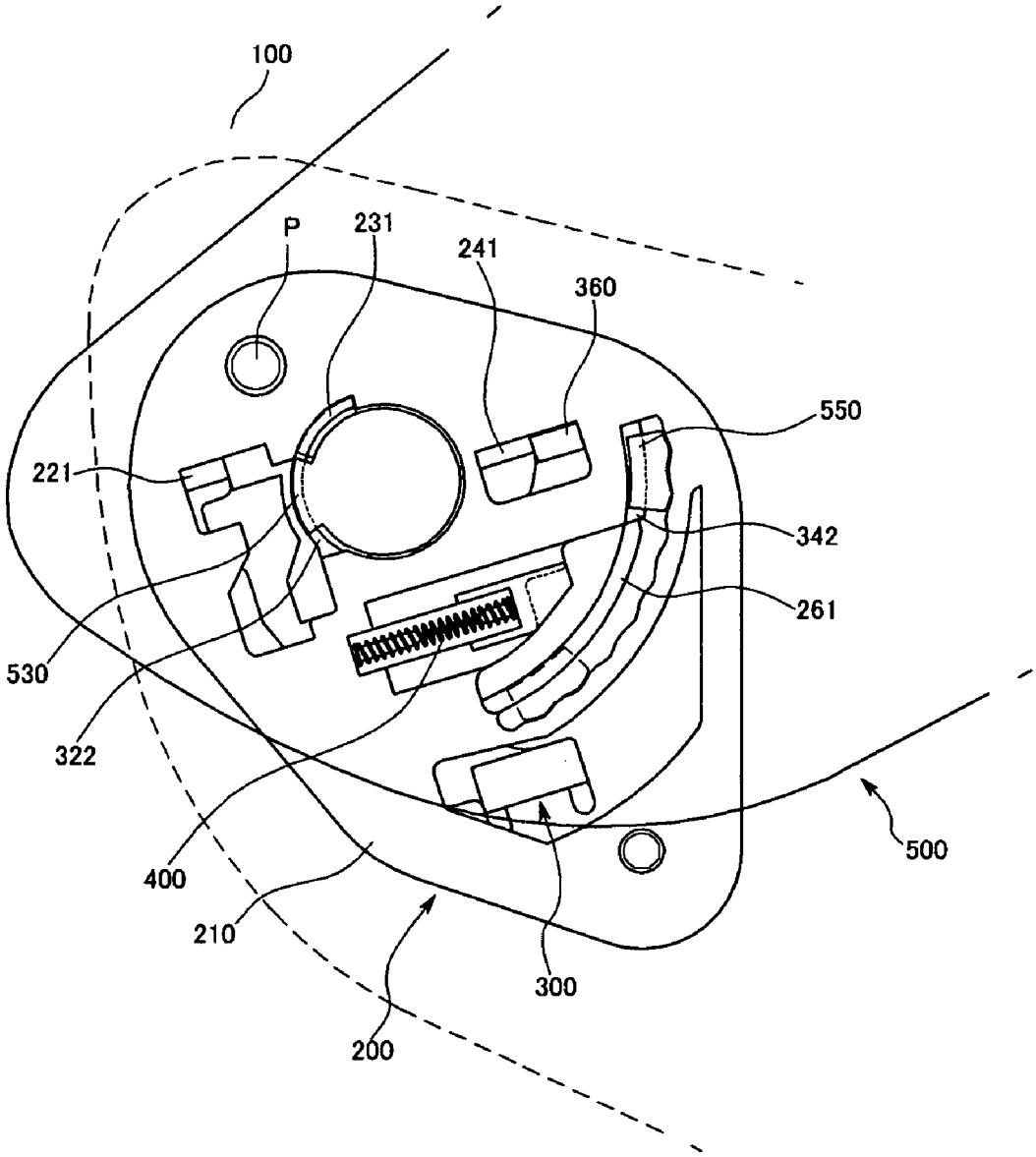
FIG. 5 is a view showing that a shield plate is rotated upwardly with respect to the helmet main body of FIG. 3.
Figure 6:
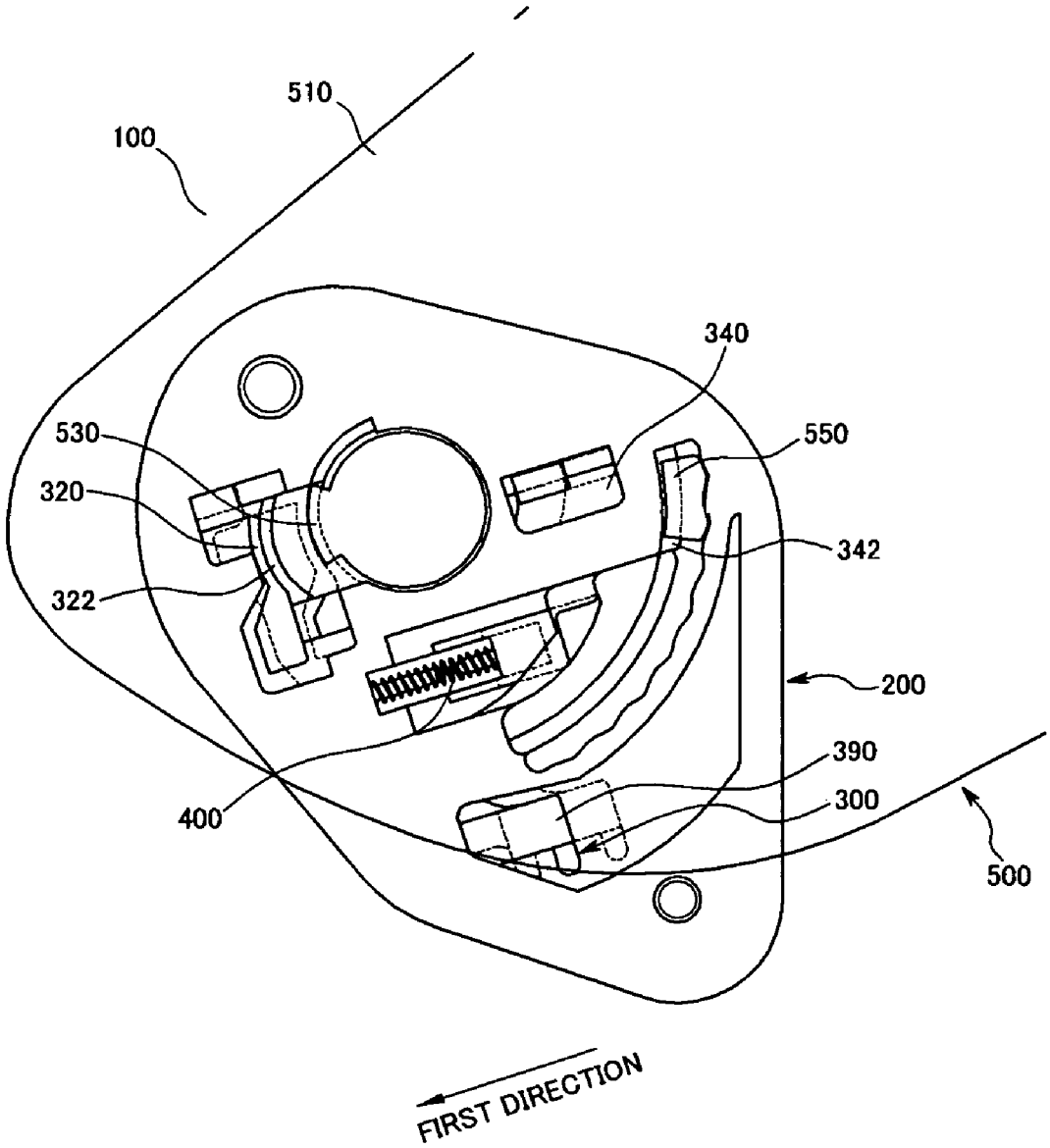
FIG. 6 is a view showing that the second plate of FIG. 5 slides with respect to a first plate.

FIG. 5 is a view showing that a shield plate is rotated upwardly with respect to the helmet main body of FIG. 3; and FIG. 6 is a view showing that a second plate of FIG. 5 slides with respect to a first plate.

Above all, as illustrated in FIG. 5, the shield plate 500 is rotated upwardly with respect to the helmet main body 100. If the shield plate 500 is rotated upwardly with respect to the helmet main body 100, the first rotating hook 530 moves from the first guide groove 231 to the first locking groove 322, and the second rotating hook 550 moves from the second guide groove 261 to the second locking groove 342. Under this situation, the second plate 300 is positioned at the locking position.

Further, as illustrated in FIG. 6, if the second plate 300 is induced to slide by using the lever 390 and moved to the unlocking position, the first locking unit 320 and the second locking unit 340 move in a first direction. Therefore, the first locking groove 322 which is locking the first rotating hook 530 of the shield plate 500 and the second locking groove 342 which is locking the second rotating hook 550 of the shield plate 500 move in the first direction, and the first rotating hook 530 and the second rotating hook 550 of the shield plate 500 are exposed toward a direction of the shield plate main body 510 so that it is possible to separate the shield plate 500 from the helmet main body 100.

Hereinafter, a method of combining the shield plate 500 with the helmet main body 100 will be explained with reference to FIG. 7.

Figure 7:
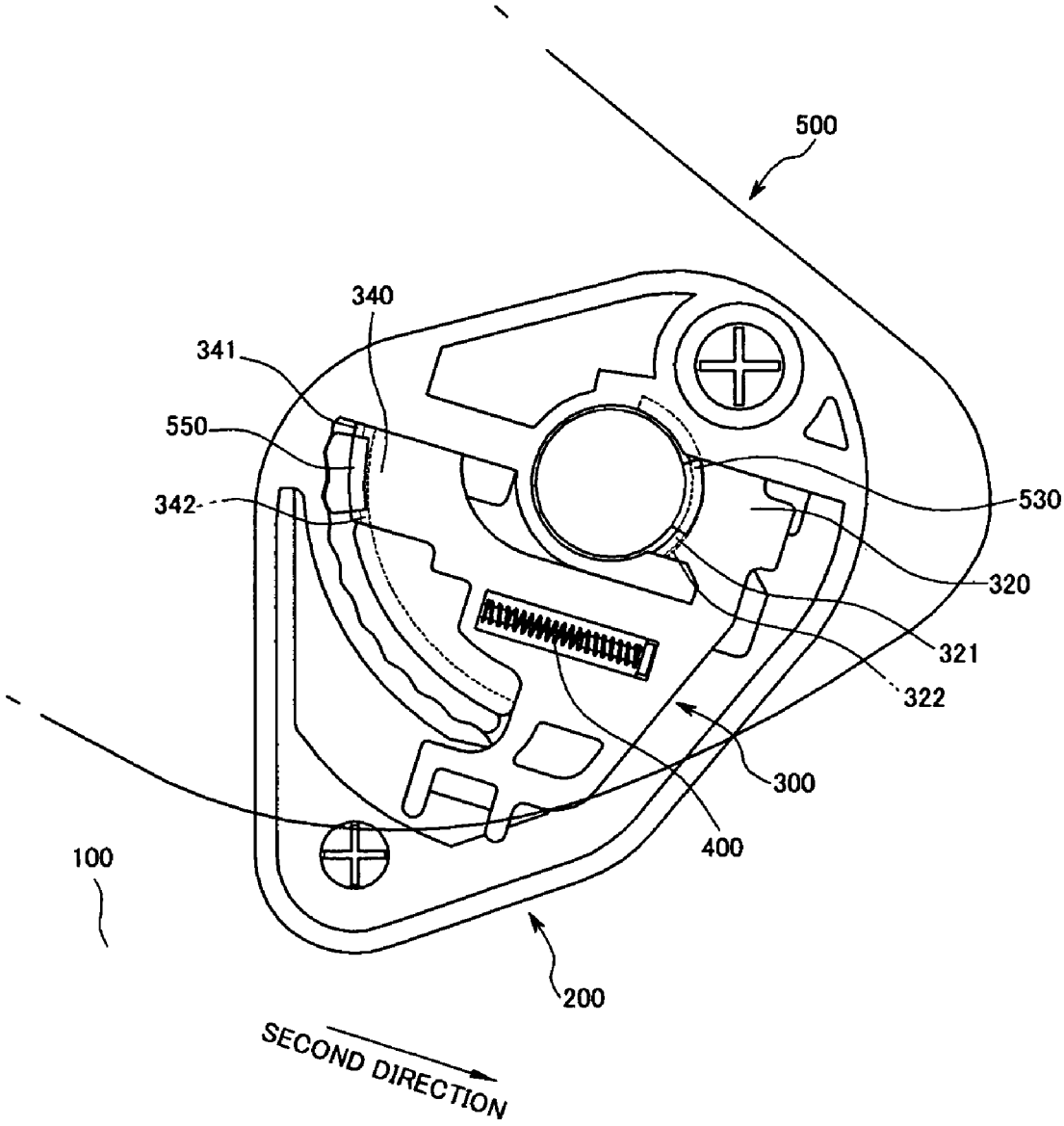
FIG. 7 is a view illustrating a status before the shield plate of FIG. 3 is combined.

FIG. 7 is a view illustrating a status before the shield plate of FIG. 3 is combined.

First of all, as illustrated in FIG. 7, the first rotating hook 530 and the second rotating hook 550 of the shield plate 500 are disposed on an end portion of the first locking unit 320 and an end portion of the second locking unit 340 respectively.

Then, if the shield plate 500 is pressurized toward a direction of the first plate 200, the first rotating hook 530 of the shield plate 500 pressurizes the first locking unit 320 in a second direction and the second rotating hook 550 pressurizes the second locking unit 340 in the second direction since the top surface 321 of the end portion of the first locking unit 320 and the top surface 341 of the end portion of the second locking unit 340 are slantly formed.

Subsequently, the second plate 300 slides in the second direction under the pressure of the first rotating hook 530 and the second rotating hook 550. Due to such slide movement, the first rotating hook 530 is positioned at the first locking groove 322 and the second rotating hook 550 is positioned at the second locking groove 342.

In this way, it is possible to combine the shield plate 500 with the helmet main body 100.

As stated above, it is possible to induce the shield plate 500 to be attached to and detached from the helmet main body 100 by a simple slide movement of the second plate 300 with respect to the first plate 200 so that the structures of the first plate 200 and the second plate 300 are simple, and the second plate 300 and the first plate 200 are structurally stably combined with each other by the structural combination between the second plate 300 including the first to third structural coupling hooks 330, 360 and 380 and the first plate 200 including the first to third structural coupling grooves 221, 241 and 262, whereby it is possible to provide the helmet 1000 having the attachable and detachable shield plate 500.

The above description of the present invention is provided for the purpose of illustration, and it would be understood by those skilled in the art that various changes and modifications may be made without changing technical conception and essential features of the present invention. Thus, it is clear that the above-described embodiments are illustrative in all aspects and do not limit the present invention. For example, each component described to be of a single type can be implemented in a distributed manner. Likewise, components described to be distributed can be implemented in a combined manner.

The scope of the present invention is defined by the following claims rather than by the detailed description of the embodiment. It shall be understood that all modifications and embodiments conceived from the meaning and scope of the claims and their equivalents are included in the scope of the present invention.

What is claimed is:

1. A helmet comprising:

a helmet main body; a first plate fixed onto an outer surface of the helmet main body; a shield plate attachably and detachably installed on the first plate; a second plate combined with the first plate and moving to a locking position or an unlocking position with respect to the first plate; and a spring for pressurizing the second plate toward the locking position, wherein the first plate includes:

a supporting sphere formed in a circular shape; a first sliding unit formed after a part of a circumferential wall of the supporting sphere is removed; a protruding partition wall extending from an outside of the supporting sphere and formed into a circular arc shape concentric with a circumferential wall of the supporting sphere; and a second sliding unit formed in one end portion of the protruding partition wall, the shield plate includes:

a rotation shaft rotatably combined with the supporting sphere; a first rotating hook formed in the rotation shaft; a click protruding unit engaged with a shield rotating guide groove formed along an outer periphery of the protruding partition wall; and a second rotating hook formed in the click protruding unit, the second plate includes:

a first locking unit engaged with the first sliding unit and a second locking unit engaged with the second sliding unit, and spaces where the first and second sliding units are formed extend toward the outside of the circumferential wall of the supporting sphere and form a slide guide groove, the second plate slides linearly along the slide guide groove, and the first and second rotating hooks are engaged with or disengaged from the first locking unit and the second locking unit respectively in the first and the second sliding units, thereby moving between the locking position and the unlocking position, wherein the first plate includes:

a first structural coupling groove formed on an upper rear surface of the first sliding unit; a second structural coupling groove formed on an upper rear surface of the second sliding unit; and a third structural coupling groove formed on an inner peripheral rear surface of the protruding partition wall, the second plate includes:

a first structural coupling hook, a second structural coupling hook and a third structural coupling hook formed on places each corresponding to the first, second and third structural coupling grooves, and the first to third structural coupling hooks are inserted into a rear surface of the first plate from a top surface thereof so as to be slid into the first to third structural coupling grooves respectively.

2. The helmet of claim 1, wherein the first plate includes:

a first guide groove formed on an inner peripheral rear surface of the supporting sphere; and a second guide groove formed on an outer peripheral rear surface of the protruding partition wall, a second plate includes:

a first locking groove extended from the first guide groove and formed on a rear surface of an end portion of the first locking unit; and a second locking groove extended from the second guide groove and formed on a rear surface of an end portion of the second locking unit, and when the shield plate rotates, the first rotating hook of the shield plate rotates along the first locking groove and the first guide groove and the second rotating hook of the shield plate rotates along the second locking groove and the second guide groove.

3. The helmet of claim 1, wherein a top surface of the end portion of the first locking unit and a top surface of the end portion of the second locking unit of the second plate are slantly formed.

4. The helmet of claim 1, wherein an inner wall of the outside of the shield rotating guide groove and an outer surface of the click protruding portion inserted and guided into the shield rotating guide groove are formed in a continuous wave shape and engaged with each other so that the shield plate can be fixed step by step when the shield plate main body rotates.

5. The helmet of claim 1, wherein the first plate further includes:

a first spring supporting unit for supporting one end portion of the spring, and the second plate further includes:

a second spring supporting unit for supporting the other end portion of the spring while facing the first spring supporting unit.

6. The helmet of claim 1, wherein the second plate further includes:

a lever with which a slide movement of the second plate can be manipulated.

* * * * *